United States Patent [19]

Brandt

[11] Patent Number: 4,754,568

[45] Date of Patent: Jul. 5, 1988

[54] ROTATING SAFETY MECHANISM FOR PROJECTILE WEAPONS

[76] Inventor: Raymond W. Brandt, 11220 St. Joe Rd., Fort Wayne, Ind. 46815

[21] Appl. No.: 107,882

[22] Filed: Oct. 9, 1987

Related U.S. Application Data

[63] Continuation of Ser. No. 790,385, Oct. 23, 1985, abandoned.

[51] Int. Cl.[4] ..... F41C 17/02

[52] U.S. Cl. ..... 42/70.06; 42/70.01

[58] Field of Search ..... 42/70.01, 70.03, 70.04, 42/70.05, 70.06, 70.07, 70.08

[56] References Cited

U.S. PATENT DOCUMENTS

| | | | |
|---|---|---|---|
| 1,227,531 | 5/1917 | Donadio | 42/70.08 |
| 2,225,583 | 12/1940 | Blizard | 42/70.06 |
| 2,458,616 | 1/1949 | Maynor | 42/70.06 |
| 4,445,292 | 5/1984 | Martin | 42/70.01 X |

*Primary Examiner*—Ted L. Parr

*Attorney, Agent, or Firm*—Marshall & Melhorn

[57] ABSTRACT

A safety mechanism for projectile weapons includes a stop means mounted to prevent the movement of the trigger and/or hammer to a position enabling the weapon to be fired. The stop means includes a generally cylindrical pin having one end extending through a wall of the weapon and the internal body under spring pressure biasing the pin to a first safety "on" position. A cam lobe is formed on the body of the internal portion and engages a portion of the trigger and/or hammer to prevent movement of the trigger and/or hammer from the disabled position. A radially extending key formed on the pin engages a slot in the wall of the weapon to prevent the pin from being rotated about its longitudinal axis. In order to disengage the safety, pressure is applied to the pin to move it to a second position along a path parallel to the longitudinal axis of the pin whereby the key is moved out of the slot to permit rotation of the pin about its longitudinal axis. Such rotation moves the cam lobe out of engagement with the trigger and/or hammer to permit the trigger and/or hammer to be actuated to fire the weapon.

6 Claims, 1 Drawing Sheet

ROTATING SAFETY MECHANISM FOR PROJECTILE WEAPONS

This is a continuation of application Ser. No. 790,385, filed 10/23/85, abandoned.

BACKGROUND OF THE INVENTION

1. Field of the Invention

The present invention relates generally to a safety mechanism for projectile weapons and in particular to a device for preventing the movement of the trigger and/or hammer of a projectile weapon to a position which could result in a discharge of a loaded weapon.

2. Description of the Prior Art

Each year many persons are killed by the unintentional or accidental discharge of projectile weapons. Projectile weapons include firearms and any device capable of propelling an object through the air such as a power nail driver or staple gun. Thus, there is a need for a device which will prevent the movement of a trigger and/or hammer to a position in which the weapon can be discharged. However, such a device must be easy to install and use in order to encourage the use of such a safety mechanism with all projectile weapons.

Many types of safety devices for firearms are known. One group of such devices involves a pin or slide which is moved into and out of engagement with the hammer such as shown in U.S. Pat. Nos. 289,875; 311,323; 792,381; and 1,227,531. Another type of safety mechanism involves a pin or lever which prevents the actuation of the trigger mechanism such as shown in U.S. Pat. Nos. 80,043; 132,222; 206,217; 239,652; 2,379,946; 2,458,616; 2,657,490; 3,153,874; 3,222,809; 3,711,979; 3,713,239; 3,713,242; 3,732,641; 3,861,069; 3,964,200; and 4,050,662. In the alternative, there is a class of devices which blocks the insertion of a finger in front of the trigger to prevent the actuation of the trigger such as shown in U.S. Pat. Nos. 1,079,855; 1,563,250; 1,569,553; 2,195,693; 2,525,886; 2,590,516; 2,664,658; 3,422,560; 3,956,842; 4,084,341; 4,198,026; 4,299,045; and 4,395,837.

All of the above mentioned prior art devices have disadvantages such as being complicated in structure and requiring substantial modifications to the firearms. With respect to those devices which utilize removable pins, the pins are easily lost rendering the safety mechanism inoperable.

SUMMARY OF THE INVENTION

The present invention is concerned with a safety mechanism for projectile weapons which is easy to install and operate and does not include a removable part which can be lost rendering the safety mechanism inoperative. A stop means in the form of a pin having a cross-section in the shape of a single lobe cam is rotatably mounted in the weapon such that the cam is in contact with a portion of either the trigger or the hammer to prevent actuation of such element and render the weapon inoperative. One end of the pin is in contact with a biasing spring which tends to bias the pin into the safety "on" position as described above. The other end of the pin is external to the firearm and has a knurled surface for a higher coefficient of friction with an actuating finger. When pressure is applied to the external end of the pin, the pin is shifted toward the interior of the firearm against the biasing spring to move a key portion of the pin from a slot. This shifting allows the pin to be rotated approximately twenty degrees to move the cam out of engagement with the trigger or the hammer thereby releasing the safety. Rotation of the pin in the opposite direction aligns the key portion with the slot and the biasing spring moves the pin back into the safety "on" position. The simultaneous pushing and rotation movement makes the safety mechanism extremely difficult for a child to operate.

It is an object of the present invention to provide a safety mechanism for a projectile weapon which can be easily operated by either a right-handed person or a left-handed person.

It is another object of the present invention to provide a safety mechanism for a firearm which is economical to manufacture and install on projectile weapons.

It is a further object of the invention to provide a safety mechanism for projectile weapons which is child resistant.

DETAILED DESCRIPTION OF THE DRAWINGS

DESCRIPTION OF THE PREFERRED EMBODIMENT

Figure 1:
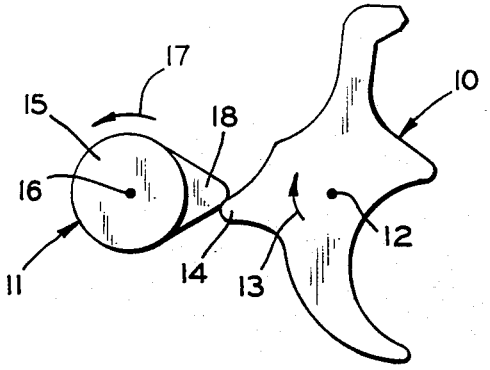
FIG. 1 is a schematic representation of a trigger and a safety mechanism according to the present invention for preventing the actuation of the trigger.
Figure 2:
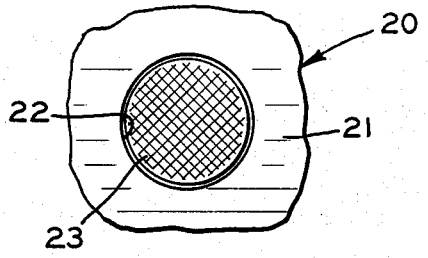
FIG. 2 is a fragmentary front elevational view of an exterior surface of a firearm and the hand engaging portion of a safety mechanism according to the present invention.

There is shown in FIG. 1 a schematic representation of a trigger 10 and a rotating safety mechanism 11 according to the present invention. The trigger 10 is mounted for rotation about a pivot point 12 in the direction of the arrow 13 for actuating the firing mechanism of a projectile weapon. A safety engaging portion 14 of the trigger 10 extends from the body of the trigger and will also rotate in the direction of the arrow 13 as the trigger is actuated. The safety mechanism 11 has a stop means in the form of a generally cylindrical body 15 mounted for rotation about its longitudinal axis 16 in the direction of the arrow 17. A cam lobe 18 is formed on an exterior surface of the body 15 and, in the safety "on" position, engages the portion 14 of the trigger 10 preventing movement of the trigger in the direction of the arrow 13.

Figure 3:
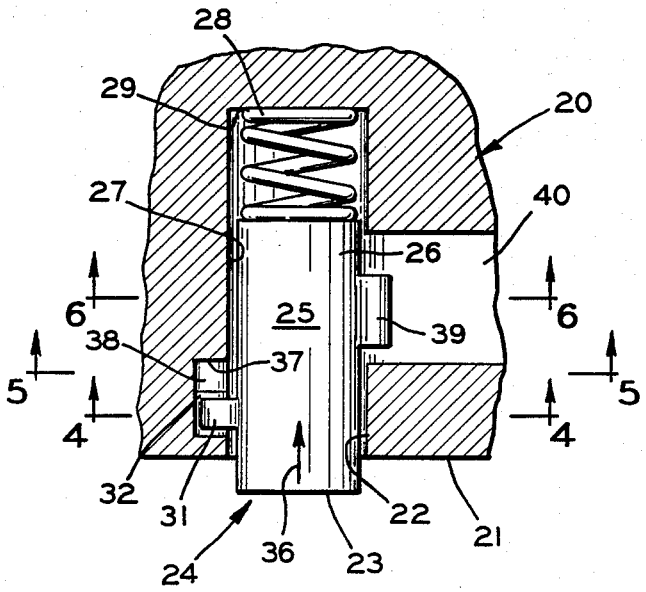
FIG. 3 is a fragmentary cross-sectional plan view taken through a portion of a firearm and showing the rotating safety mechanism according to the present invention.

There is shown in FIGS. 2 through 6 a safety mechanism according to the present invention installed in a projectile weapon. The weapon 20 has an exterior surface 21. Extending from the exterior surface 21 through an aperture 22 is one end 23 of a pin 24 which is one element of a rotating safety mechanism according to the present invention. The end 23 has a knurled surface for increasing the coefficient of friction between it and a tip of a human finger. As shown in FIG. 3, the pin 24 has a generally cylindrical body 25 which is rotatably supported in a generally cylindrical cavity 27 formed in the body of the firearm 20. An end 26 of the cylindrical body 25 opposite the end 23 abuts one end of a helical spring 28 having its other end abutting a wall 29 of the cylindrical cavity 27. The spring 28 functions as a biasing means which tends to bias the pin 24 into the position shown in FIG. 3 which is the safety "on" position.

Figure 4:
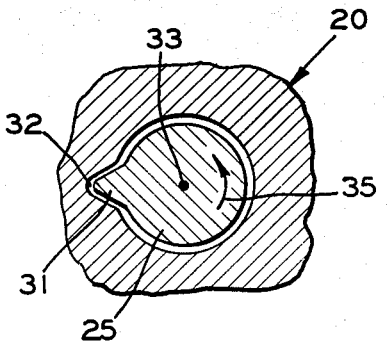
FIG. 4 is a fragmentary cross-sectional view taken along the line 4—4 of FIG. 3.

As shown in FIGS. 3 and 4, the cylindrical body 25 has a radially extending key 31 formed thereon. Although the key 31 has been shown in the general shape of a cam lobe, it could be of any suitable shape. The key 31 is retained in a similarly shaped slot 32 formed in the body of the weapon 20. The slot 32 is dimensioned to effectively prevent rotation of the cylindrical body 25 about its longitudinal axis 33. Thus, the key 31 and the slot 32 function as a locking or latching means.

Figure 5:
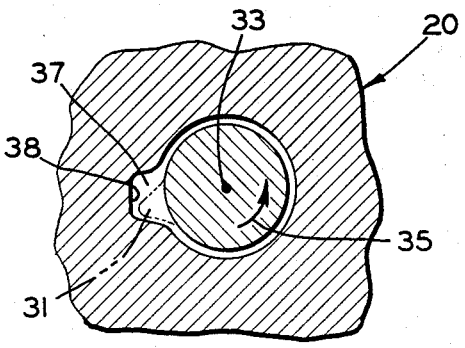
FIG. 5 is a fragmentary cross-sectional view taken along the line 5—5 of FIG. 3.

Referring to FIGS. 3 and 5, the pin 24 is shifted in the direction of the arrow 36 by applying pressure to the end 23 to compress the spring 28 between the end 26 and the wall 29. The pin 24 will move in the direction of the arrow 36 until the key 31 engages a back wall 37 of a cavity 38 adjacent the slot 32. Referring to FIG. 5, the cavity 38 is substantially larger than the slot 32 and permits rotation of the cylindrical body 25 about the longitudinal axis 33 in the direction of the arrow 35 such that the key 31 rotates to the position shown by the phantom lines. This position of the pin is the safety "off" position and is achieved by the pushing or applying of pressure to the end 23 followed by the rotating of the cylindrical body 25. This movement is typically achieved with the end of a single finger and is extremely difficult for a child to accomplish.

Figure 6:
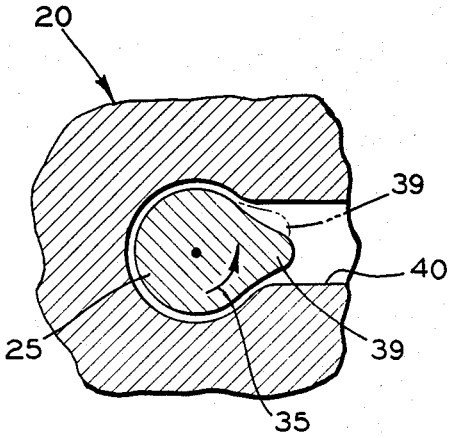
FIG. 6 is a fragmentary cross-sectional view taken along the line 6—6 of FIG. 3.

As shown in FIGS. 3 and 6, the cylindrical body 25 has a radially extending cam lobe 39 formed thereon. The cam lobe 39 is the equivalent of the cam lobe 18 in FIG. 1 and is adapted to engage a portion of a trigger mechanism (not shown) in a manner similar to that shown in FIG. 1. When the cylindrical body 25 is rotated in the direction of the arrow 35, the cam lobe 39 is moved to the position shown in the phantom lines and out of engagement with the trigger mechanism. The degree of rotation of the cylindrical body 25 can be limited by the dimensions of the cavity 38 and of the key 31 which will tend to engage opposite walls of the cavity in the safety "on" and safety "off" positions. Also, the degree of rotation of the cylindrical body 25 could be limited by the dimensions of the cam lobe 39 and the spacing of the walls of a cavity 40 in which the cam lobe 39 rotates. In either case, the rotation typically can be limited to about twenty degrees.

In order to move the safety mechanism from the safety "off" position to the safety "on" position, the cylindrical body 25 is rotated by a finger in a direction opposite to the arrow 35 to align the key 31 with the slot 32. When the pressure is released from the end 23 of the body 25, the spring 28 will urge the cylindrical body 25 in the direction opposite the arrow 36 to restore the pin to the position shown in FIG. 3 in which the safety is "on".

The shapes and structures shown in the drawings are illustrative of one form of the present invention. The spring, key, slots, cam lobe, and directions of movement can all be varied without departing from the requirement of applied pressure to unlock the safety mechanism and rotation to move the mechanism between the safety "on" and safety "off" positions.

In accordance with the provisions of the patent statutes, the principle and mode of operation of the invention have been explained in its preferred embodiment. However, it must be understood that the invention may be practiced otherwise than as specifically illustrated and described without departing from its spirit or scope.

What is claimed is:

1. A safety mechanism for a projectile weapon, the weapon including an element pivotally mounted for movement between a position wherein the weapon can not be fired and an actuated position wherein the weapon is capable of being discharged, comprising:

a pin having a generally cylindrical body adapted to be retained in a generally cylindrical cavity;

a generally cylindrical first cavity formed in a projectile weapon for slidably and rotatably retaining said pin;

biasing means connected between an end of said pin and a wall of said first cavity for biasing said pin along a path of travel generally parallel to a longitudinal axis of said pin to a safety "on" first position, said pin being movable along said path of travel from said first position to a second position against the bias of said biasing means;

a cam lobe extending radially from said pin cylindrical body into a second cavity formed in a wall of said first cavity and into engagement with an element of the weapon in said first and second positions of said pin; and latching means including a key formed on said pin for engaging a slot formed in a wall of said first cavity for preventing rotation of said pin about its longitudinal axis when said pin is in said first position and a third cavity formed in a wall of said first cavity adjacent said slot for receiving said key and for permitting rotation of said pin about its longitudinal axis when said pin is in said second position to move said cam lobe out of engagement with the element to a safety "off" position wherein the element can be moved to an actuated position.

2. The safety mechanism according to claim 1 wherein said biasing means is a helical spring having one end abutting a wall of said first cavity and an opposite end engaging said pin.

3. The safety mechanism according to claim 1 wherein said pin has one end extending through a wall of the projectile weapon, said one end having a knurl formed thereon for enabling said pin to be rotated by a human finger.

4. The safety mechanism according to claim 1 wherein said key extends radially from said pin cylindrical body.

5. The safety mechanism according to claim 1 wherein the element is a trigger pivotally mounted on the weapon.

6. The safety mechanism according to claim 1 wherein the element is a hammer pivotally mounted on the weapon.

* * * * *